United States Patent [19]

Jones

[11] Patent Number: 5,004,230

[45] Date of Patent: Apr. 2, 1991

[54] METHOD AND APPARATUS FOR EXERCISING OR TESTING ROTARY TORSO MUSCLES

[76] Inventor: Arthur Jones, 1155 NE. 77th St., Ocala, Fla. 32670

[21] Appl. No.: 451,129

[22] Filed: Dec. 15, 1989

Related U.S. Application Data

[63] Continuation-in-part of Ser. No. 361,055, Jun. 5, 1989, and a continuation-in-part of Ser. No. 307,706, Feb. 8, 1989, and a continuation-in-part of Ser. No. 307,473, Feb. 8, 1989, and a continuation-in-part of Ser. No. 236,367, Aug. 25, 1988, Pat. No.

[51] Int. Cl.[5] ..... A63B 21/00

[52] U.S. Cl. ..... 272/134; 272/118

[58] Field of Search ..... 272/96, 97, 117, 118, 272/125, 134, 143, 144, DIG. 4, 129; 128/25 R

[56] References Cited

U.S. PATENT DOCUMENTS

| | | | |
|---|---|---|---|
| 4,278,249 | 7/1981 | Forrest | 272/94 |
| 4,515,363 | 5/1985 | Schleffendorf | 272/118 |
| 4,628,910 | 12/1986 | Krukowski | 128/25 R |
| 4,635,933 | 1/1987 | Schnell | 272/134 X |
| 4,725,055 | 2/1988 | Skowronski | 272/144 |
| 4,732,380 | 3/1988 | Maag | 272/134 X |
| 4,732,381 | 3/1988 | Skowronski | 272/134 |
| 4,763,897 | 8/1988 | Yakata | 272/118 |
| 4,765,315 | 8/1988 | Krukowski | 128/25 R |
| 4,768,779 | 9/1988 | Oehman et al. | 272/94 |

*Primary Examiner*—Robert Bahr

*Attorney, Agent, or Firm*—William E. Mouzavires

[57] ABSTRACT

Method and apparatus for exercising or testing the rotary torso muscles in which the chest and shoulder area of the subject is secured against movement while the pelvis is also secured against movement to isolate the rotary torso muscles for testing or exercise. The subject while so secured and seated exerts a force with the rotary torso muscles to rotate a movement arm about a vertical axis against a resistance suitably chosen from a weight stack to be less than the maximum static strength of said muscles. The subject then returns to the starting position and repeats the exercise until the rotary torso muscles can no longer rotate the movement arm. The subject's static strength is measured by fixing the movement arm in several different angular positions and measuring the force exerted by said muscles on the movement arm in each of said positions.

17 Claims, 3 Drawing Sheets

METHOD AND APPARATUS FOR EXERCISING OR TESTING ROTARY TORSO MUSCLES

RELATED APPLICATIONS

The present application is a continuation in part of my prior co-pending U.S. Pat. applications Ser. Nos. 07/361,055 filed June 5, 1989, pending, 07/307,706 filed Feb. 8, 1989, pending; 07/307,473 filed Feb. 8, 1989, pending, and 07/236,367 filed Aug. 25, 1988 now U.S. Pat. No. 4,902,009, which in turn is a continuation in part of my U.S. Pat. application, Ser. No. 60,679, filed June 11, 1987 and now issued as U.S. Pat. No. 4,836,536. The disclosure of each of the aforementioned applications is hereby incorporated by reference into the present application as part hereof.

BACKGROUND OF INVENTION

There exists in the prior art methods and apparatus for exercising the rotary torso muscles of the human body. See for example applicant's U.S. Pat. No. 4456245 issued June 26, 1984. Such methods and apparatus however fail to effectively isolate the rotary torso muscles from other muscles which are therefore free to combine with the torso muscles in the exercise, such that the exercise is rendered inefficient and/or inaccurate insofar as directed to the rotary torso muscles per se. Although such prior method seeks to essentially isolate the rotary torso muscles by restricting movement of the upper and lower torso, there is no provision for positively preventing movement of the upper and lower torso. Consequently the rotary torso muscles are not sufficiently isolated from other muscles to enable true measurement of the strength of the rotary torso muscles per se.

OBJECTS OF THE PRESENT INVENTION

It is an object of the present invention to provide novel methods and apparatus for testing and/or exercising rotary muscles of the human body in a safe, efficient and accurate manner. Included herein are such methods and apparatus for exercising or testing in an improved manner, the rotary torso muscles of the human body.

Another object of the present invention is to provide such a method and apparatus which effectively isolates the rotary torso muscles for testing or exercise of these muscles only.

A further object of the present invention is to provide novel method and apparatus for safely and accurately testing the static strength of the rotary torso muscles in each of a plurality of different, predetermined angular positions of the torso about a generally vertical axis.

Another object of the present invention is to provide such novel method and apparatus for effectively immobilizing the upper and lower torso portions leaving the thoracic rotary torso muscles free for exercise and/or testing.

SUMMARY OF INVENTION

Summarizing a preferred embodiment of the present invention, method and apparatus are provided which secure against movement, the chest and pelvic areas of the torso leaving the rotary torso muscles at the thoracic vertebra between said areas isolated for exercise and/or testing. A new patient or subject is first given a static strength test of his/her torso muscles by having the isolated torso muscles exert a torsional force about a generally vertical axis against a movement arm which is fixed in a known angular position about a vertical axis. The exerted force is measured and the process is repeated at different angular positions of the movement arm about the vertical axis so as to correlate static strength with the angular position of the torso.

In order to provide dynamic exercise of the rotary torso muscles, the movement arm is released for angular movement or rotation about said vertical axis in response to forces generated by the rotary torso muscles to rotate the movement arm about said axis. A yieldable resistance preferably a dead weight or weights is connected to the movement arm to oppose movement of the movement arm in one direction. The magnitude of the weight is chosen to be safely less than the maximum static strength of the subject's rotary torso muscles. Starting with the torso positioned toward one side of the body at an angle, the subject rotates the torso and in turn the movement arm towards and to the other side against the bias of the resistance weight and then the subject reverses rotation of the torso allowing the resistance weight to return the movement arm to the starting position. The aforementioned process is repeated until the rotary torso muscles become fatigued and are no longer capable of rotating the movement arm at which point the exercise is completed. The static strength of the subject's rotary torso muscles is then measured again immediately after the exercise in order to determine the effect of the exercise on the subject's rotary torso muscles. Such information is valuable in that it will enable the type of muscle fiber to be determined for the particular subject. The aforementioned exercise not only utilizes a resistance weight that is safely less than the maximum static strength of the subject's rotary torso muscles, but in addition, the resistance weight is moved over a relatively short stroke on the order of about three inches (3") so that no significant kinetic energy can be generated to risk injury to the rotary torso muscles.

DRAWINGS

Other objects and advantages of the present invention will become apparent from the following, more detailed description taken in conjunction with the attached drawings in which.

DETAILED DESCRIPTION

Figure 1:
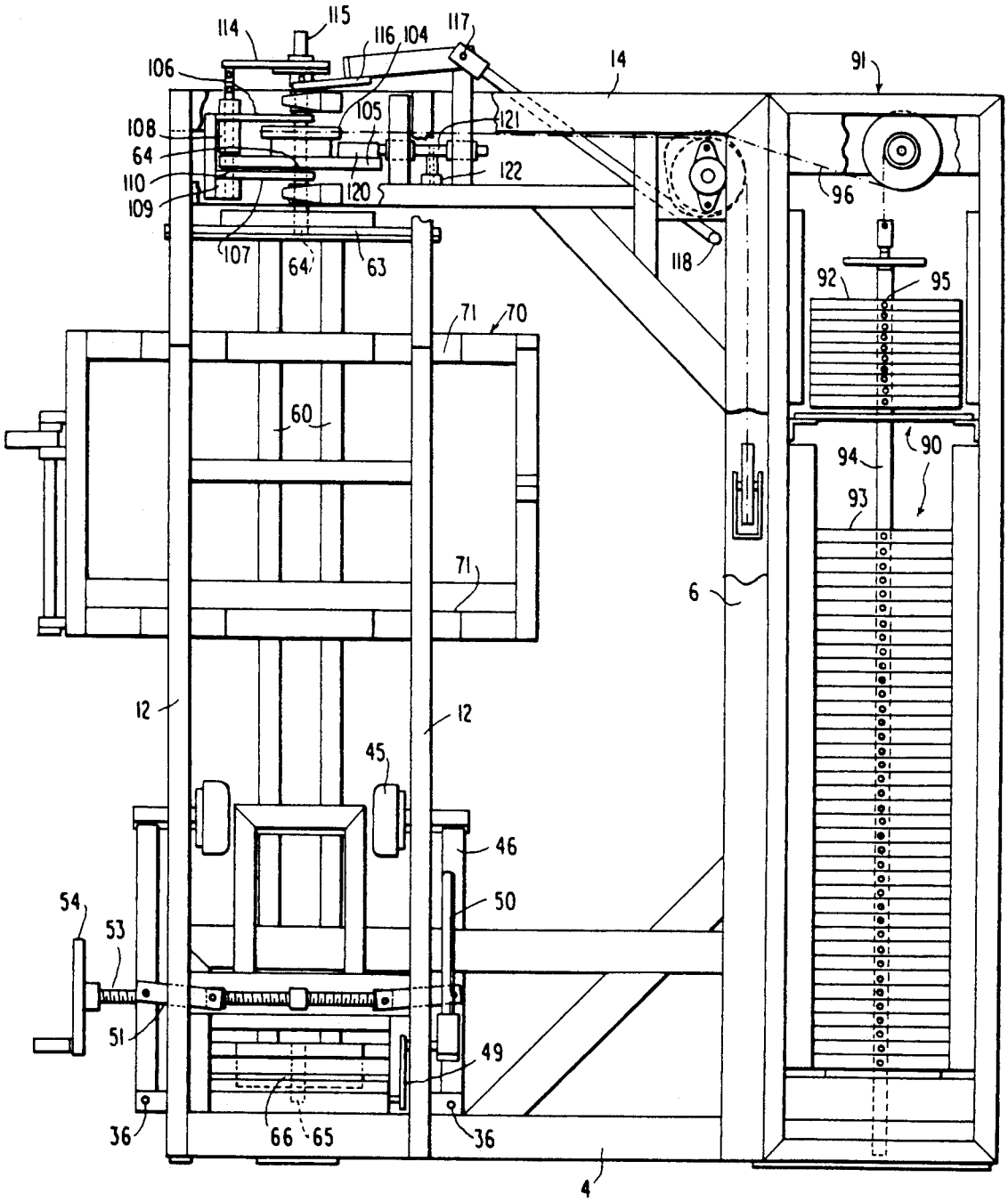
FIG. 1 is a front elevational view of apparatus constituting a preferred embodiment of the present invention and with certain parts removed for clarity.

Referring now to the drawings in detail that are shown for illustrative purposes only apparatus constituting a preferred embodiment of the present invention for exercising and/or testing the rotary torso muscles of the human body which muscles exist at the thoracic spine above the lumbar muscles and below the shoulder or upper chest areas. The apparatus includes a stationary frame including a rectangular base frame including structural frame members such as 4 and 10 shown in FIGS. 1 and 3 respectively. Upstanding from the base frame is a vertical frame including a pair of vertical frame members 12 shown in FIG. 1 and interconnected by crossbrace 13 at the front of the frame. The upper part of the frame includes frame members 8 shown in FIG. 3 which intersect with a frame that extends at right angles as shown in FIG. 2 and includes frame members 14 and a weight stack frame generally designated 91 in FIGS. 1 and 2.

Figure 3:
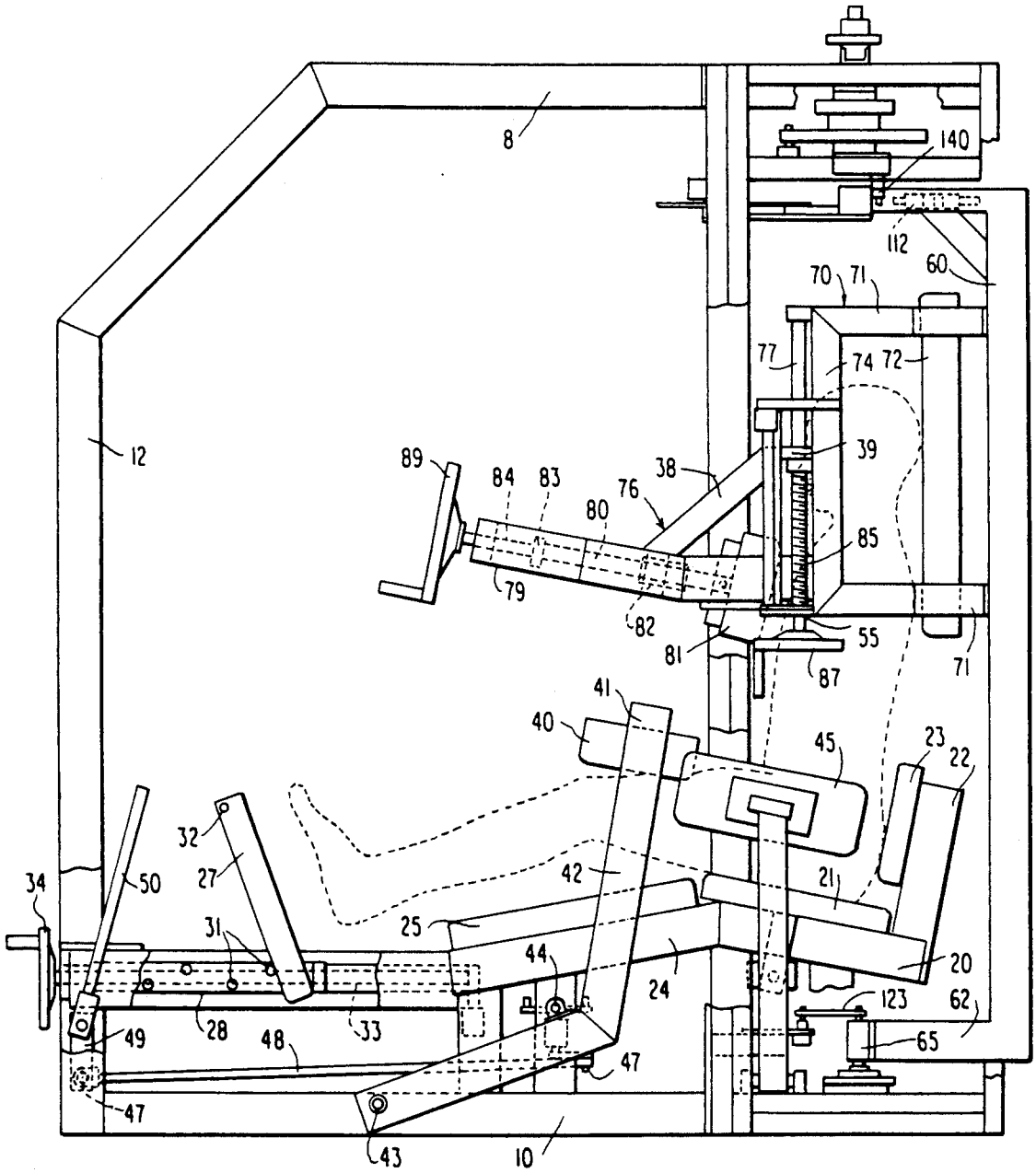
FIG. 3 is a side elevational view of the apparatus with certain portions removed for clarity.

The apparatus includes a seat for receiving the patient or subject whose rotary torso muscles are to be exercised or tested, the seat including a frame 20 shown in FIG. 3 as extending at a slight angle in the rearward direction relative to the horizontal and including a seat pad 21, these members being fixed relative to the base frame by vertical members. At the rear of the seat is a pelvic pad 23 adapted to engage the lower back at the pelvic area, the pad 23 being fixed to a frame 22 upstanding from seat frame 20 as shown in FIG. 3. The patient's legs are supported on a leg support including a frame 24 projected forwardly from the seat frame 20 and including a pad 25 and being fixed to the base frame 10 by vertical frame members in any suitable manner.

In addition to the leg rest 25, a footrest support is provided shown as a generally rectangular element 27 which may have any suitable construction, mounted in a carriage generally designated 28 which in turn is mounted for horizontal movement towards or away from the seat 20 in order to adjust the footrest to the particular size of the subject or patient. In the preferred embodiment, the footrest 27 is removably received in the carriage between any of pair of rods 31 shown in FIG. 3 depending on the size of the subject. A handle 32 in the form of a rod extending across the top of the footrest 27 as shown in FIG. 3 is provided for handling the footrest. The footrest carriage includes crosspieces or yokes 29 which are mounted on guide rods 30 shown in FIG. 2 for movement along the guide rods towards or away from the seat 20. Movement of the carriage 28 to adjust the position of the footrest 27 is achieved in the preferred embodiment through means of a nonadvancing screw rod 33 received through the yoke members 29 of the carriage and receiving a nut fixed to the carriage and having threads engaged with the threads on the screw 33. Rotation of the screw 33 such as through the handwheel 34 will cause the yoke 29 to move along the guide rods 30 towards or away from the seat to adjust the position of the footrest 27. Such adjustment is utilized to bring the upper portions of the legs just above the knees and in the thigh area against an upper leg restraint pad 40 shown in FIG. 3 with the femurs extending rearwardly and downwardly so as to prevent the pelvis of the subject from rotating. Once the pelvis is secured against movement, the buttocks and the hamstring muscles cannot enter into any exercise or measurement of the rotary torso muscles.

Figure 2:
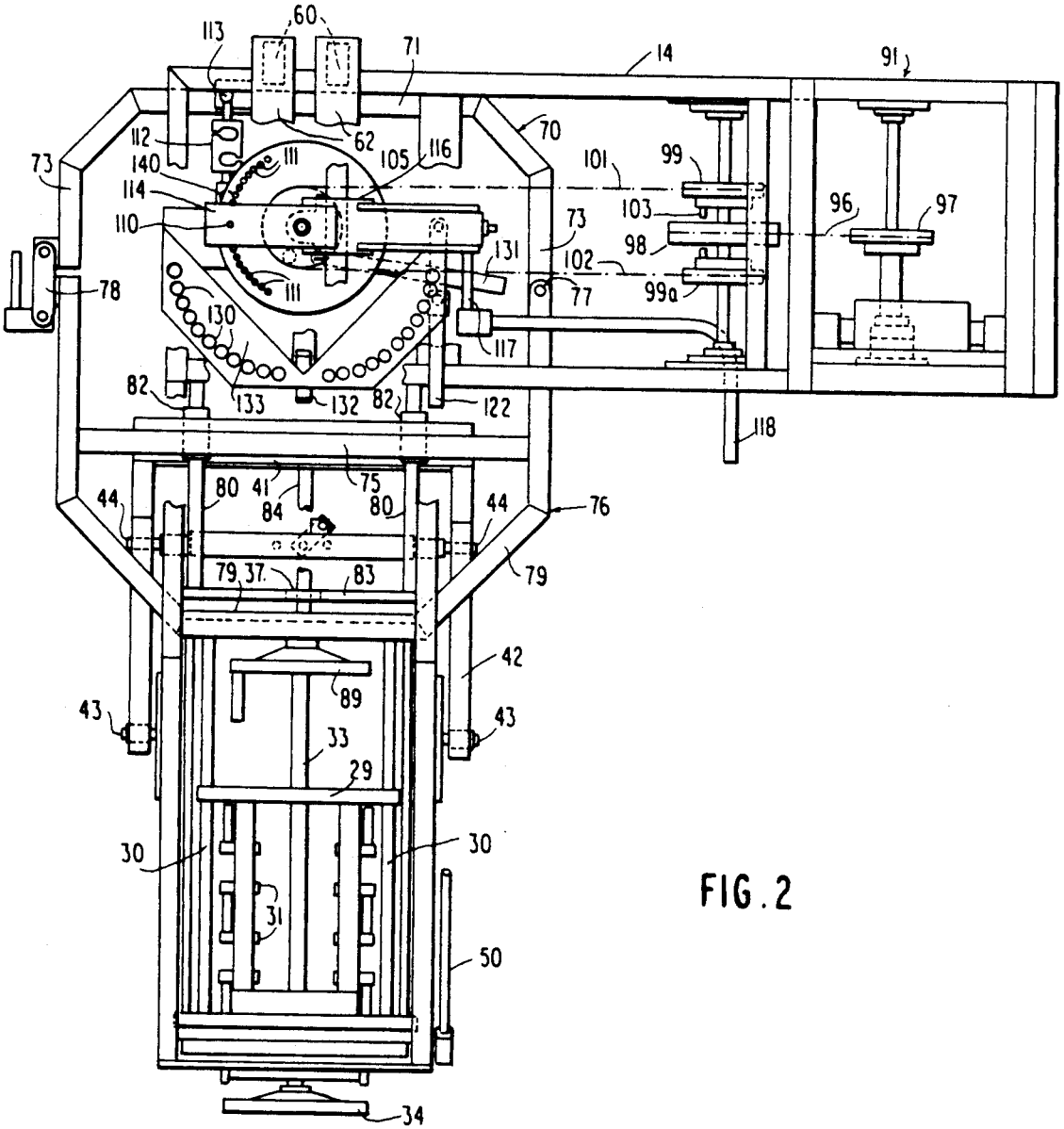
FIG. 2 is a plan view of the apparatus shown in FIG. 1 with certain portions removed for clarity.

In the specific embodiment shown, pad is mounted to the crosspiece 41 of a yoke arm 42 whose opposite sides at the bottom are pivoted by pin 43 to the base frame members 10 as shown in FIGS. 2 and 3. Yoke arm 42 is pivotable about the horizontal axis defined by the pivot pins 43 between a closed position shown in FIG. 3 wherein the pad 40 engages the upper portions of the thighs just rearwardly of the knees to secure the patient legs and pelvis against movement, and an open position (not shown) forwardly of the seat to allow the patient to leave the seat or enter the seat. Once in the closed position shown in FIG. 3, the pad arm 42 is locked therein in any suitable manner such as the slide bolts or pins 44 shown in FIGS. 2 and 3 as overlying the upper surface of the lower part of yoke arm 42 to prevent pivotal movement of the arm 42 in the counter-clockwise direction as viewed in FIG. 3. Slide bolts 44 may be actuated by any suitable means such as a linkage including a rod 48 having pivotal connections 47 at the opposite ends thereof to the slide bolts 44 and to actuating means including a pivot handle 50 and link 49 interconnecting the latter with the rod 48. Pivoting of handle 50 in one direction will slide the bolts 44 over the surface of the yoke arm 42 to lock the yoke arm as shown in FIG. 3 while pivoting of the handle 50 in the opposite direction will retract the bolts 44 inwardly away from the yoke arm 42 to allow pivotal movement of the latter.

The subject's pelvis and legs are further restrained against movement during testing and/or exercise by means of a pair of hip pads 45 mounted on opposite sides of the seat as shown in FIGS. 1 and 3 on pivot arms 46 best shown in FIG. 1. The latter are pivotally mounted by pivot pins 36 shown in FIG. 1 for movement about horizontal axes of the pivots 36 between a closed position shown in FIGS. 1 and 3 for engaging the opposite sides of the thighs and hips to secure the subject and an open position displaced outwardly from the position shown in FIG. 1 for allowing the subject to enter or leave the seat of the apparatus. Actuation of the hip pad arms 46 may be achieved in any suitable manner such as, for example, a non-advancing screw actuator including a rod 53 including a non-advancing screw on which is threadedly engaged nuts which are connected to the arms 46 respectively. Rotation of the screw such as by the handwheel 54 shown in FIG. 1 will move the arms 46 about the pivots 36 inwardly to engage the thighs of the subject with pads 45 and rotation in the opposite direction will of course move the pads 45 outwardly to release the thighs of the subject.

In addition to positively securing the pelvis against movement, the apparatus of the present invention also positively secures the upper chest and shoulder areas of the patient against movement so that the rotary torso muscles at the thoracic spine extending between those secured areas are isolated for exercise or testing. In the preferred embodiment shown, the upper chest and shoulder areas are immobilized through means of a pair of what will be termed "chest pads" 81 there being only one shown in FIG. 3. Chest pads 81 are pivotally mounted to the ends of slidable rods 80 slidably received in sleeves 82 fixed to a cross frame member 41 of what will be termed a "chest pad gate" frame generally designated 76.

Although sleeves 82 have been shown in FIG. 2, the chest pads 81 have been omitted from FIG. 2 for clarity. However one pad 81 is shown in FIG. 3 and the other pad not shown is identical. As shown in FIG. 2 the chest pad gate includes a generally U-shape front frame including frame members 79 which are hinged to a rear frame generally designated 70 which includes upper and lower rear pieces 71 fixed to vertical frame members 60 of a movement arm as shown in FIGS. 1 and 3. Rear frame 70 includes side numbers 73 terminating at vertical frame numbers 74 as shown in FIG. 3. Chest gate 76 is hinged to rear frame 70 by means of a hinge pin 77 fixed to frame member 74 as shown in FIGS. 2 and 3. As best shown in FIG. 3, chest gate 76 has a diagonal frame strut 38 terminating in an apertured flange 39 mounted about hinge pin 77 of the rear frame to mount the chest gate relative to the rear frame for swinging movement about the axis of hinge pin 77. Chest gate frame 76 is also mounted to a vertical actuating screw 85 mounted to the vertical member 74 of frame 70 as best shown in FIG. 3. A nut 55 shown in FIG. 3 is fixed to the chest gate 76 and mounted on the actuating screw 85 so that upon rotation of the actuating screw 85 by means of a handwheel 87, the chest gate will move along the actuating screw 85 in a vertical direction to adjust the level of the chest pads 81 to suit the dimensions of the subject being exercised or tested.

In order for the subject to gain entry to the seat 21 of the apparatus for use or to leave the apparatus after use, chest gate 76 is swung outwardly about hinge pin 77. After the subject is seated chest gate 76 is returned to closed position shown in FIG. 2, and any suitable latch such as that designated 78 in FIG. 2 may be employed to releaseably hold the chest gate 76 in the closed position.

In use of the apparatus for exercising the rotary torso muscles, after the subject has been secured on the seat 21 with his pelvis secured against movement and with his upper torso at the chest and shoulder areas secured against movement by the chest pads 81, the subject exerts a force with his rotary torso muscles about a generally vertical axis which will rotate the entire cage about a vertical axis defined by aligned upper and lower vertical shafts 64 and 65 mounted in the stationary frame of the apparatus as best shown in FIG. 1. The cage frames 70, 76 as noted above are fixed to the elongated vertical members 60 of the movement arm. The upper ends of members 60 are fixed to horizontal members 62 fixed to a yoke 63 which is connected to the vertical shaft 64. The lower ends of members 60 are fixed to horizontal members 62 interconnected by a cross piece 66 to which the lower shaft 65 is connected. It will therefore be seen that the cage 70, 76 together with the vertical members 60 in effect provide a movement arm movable about a vertical axis passing through the pivot shafts 64, 65. The movement arm will rotate about this axis in response to forces exerted on it by the subject's rotary torso muscles as the subject exerts rotational forces against the movement arm.

In the preferred embodiment, the exercise is started with the subject's torso facing to one side of the subject. The subject is then asked to exert his rotary torso muscles to move the movement arm towards the other side of the subject against a freely, yieldable resistance, preferably provided by one or more dead weights. The latter are connected to the movement arm such that rotation of the movement arm in one direction by the subject will move the weights in one direction and rotation of the subject back toward the starting position will cause the movement arm to return to the starting position by the force of the weights returning to their starting position. In the preferred embodiment the resistance weights ar two or more weight stacks preferably a compound weight stack as disclosed in my prior copending applications identified above. With such an arrangement, the weight stack is lifted by the force of the subject's rotary torso muscles when the subject moves from one side to the other side and then upon return of the subject to the original starting position, the weight stack will descend by gravity causing the movement arm to return to the starting position. The exercise is repeated until the subject's rotary torso muscles become fatigued and are no longer able to rotate the movement arm to lift the resistance weight.

In the preferred embodiment, the compound weight stack includes a stack of lower weights 93 and a stack of upper weights 92 positioned above the lower weights 93 as best shown in FIG. 1. Both stacks of weights, 92 and 93, are connectable to a vertical rod 94 extending through the weights. The weights have apertures 95 for receipt of a key to connect the weights to the rod 94, which also has apertures to receive the key. A more detailed description of the compound weight stack may be obtained by reference to the above-identified applications. The weight rod 94 of the compound weight stack is suspended from a cable or chain 96 which is trained about a pulley 97 shown in FIG. 2 from which it leads to a cam 98; both the pulley 97 and cam 98 being of course mounted for movement about horizontal axes. Cam 98 is driven by either of two pulleys 99 or **99*a* located on opposite sides of cam 98 to alternatively drive the cam 98 through dogs 103 depending on the direction of rotation of the movement arm. Pulleys 99 and 99*a* have trained thereabout cables or chains 101 and 102 respectively which extend in horizontal planes to a sprocket 104 mounted for rotation about the upper movement arm pivot shaft 64 as best shown in FIG. 1. When the sprocket 104 is rotated in one direction about the axis of shaft 64 such as when the subject exerts a force tending to rotate the movement arm from one side to the other against the bias of the resistance weights. One of the pulleys 99 or 99*a* will become effective to rotate the cam 98 which in turn will rotate the pulley 97 and cause the weight stack to be lifted. When the subject returns to the starting position, the weight stack will lower by gravity and cause the movement arm to rotate in the opposite direction to the starting position; when the exercise is started from the opposite side, the other of the pulleys 99 or 99*a* will become effective to drive the cam 98 to lift the resistance weight. In the preferred embodiment shown, the sprocket 104 is formed as a hub fixed to a disk 105 mounted about the pivot shaft 64. The movement arm 60, 62 is releasably connected to the sprocket 104 by means of a vertical slide pin 110 as shown in FIG. 1 which is slidably mounted in sleeves 108 and 109 fixed to a yoke including arms 106 and 107 mounted about the pivot shaft 64. As shown in FIG. 2, the sprocket disk 105 has a plurality of angularly spaced apertures 111 each of which is dimensioned to receive the slide pin 110 to connect the sprocket 104 to the movement arm. In the specific embodiment shown, a strain gauge generally designated 112 and best shown in FIG. 2 is utilized to connect the movement arm to the yoke which houses the slide pin 110. Referring to FIG. 2, one end 113 of the strain gauge 112 is fixed to the movement arm at the element 62 thereof while the other end of the movement arm is fixed, through means of a pin 140, to sleeve 109 of the yoke as shown in FIG. 3**.

It will therefore be seen that once the slide pin 110 extends through one of the apertures 111 of the sprocket disk 105, the movement arm 60, 62 will be connected to the sprocket disk 105 and in turn the sprocket 104 such that rotation of the movement arm about the vertical axes of pivot shafts 64, 65 will cause the weight stack to be lifted and when pressure is removed from the movement arm the movement arm will rotate in the opposite direction under the force exerted by the descending resistance weights.

In order to extend the slide pin 110 into the sprocket disk 105 or to withdraw the slide pin 110 therefrom, the upper end of the slide pin 110 is connected to a horizontal arm 114 which is mounted on a sleeve 115 as shown in FIG. 1. Sleeve 115 is slidably mounted on the upper end of the pivot shaft 64 to be raised by a lever 116 which is received about the pivot shaft 64 below the sleeve 115. Lever 116 is mounted for pivotable movement about a horizontal pivot axis 117 by means of a handle 118 as shown in FIG. 1. Depressing handle 118 will cause the lever 116 to pivot in a clockwise direction as viewed in FIG. 1 to raise the slide pin 110 out of the sprocket disk 105 whereas release of the handle 118 will cause the lever 116 to pivot by gravity in a counter clockwise direction as viewed in FIG. 1 to lower the slide pin 110 into the sprocket disk 105.

In order to measure the static strength of the subject's rotary torso muscles, the movement arm must be brought to a fixed position, and in the preferred embodiment this is accomplished by a slide or latch pin 121 which is receivable in a passage 120 formed in a block fixed to the sprocket disk 105 as best shown in FIG. 1. Extension of the pin 121 into the block 120 will fix the sprocket 105, 104 and in turn the movement arm against movement while retraction of pin 121 from the block 120 will free the sprocket and movement arm for movement about the axes of shafts 64, 65. Actuation of the pin 121 is achieved in any suitable manner such as by a lever 122 connected intermediate the ends of pin 121, to be movable in a horizontal plane to extend or retract the pin 121.

The static strength of the subject's rotary torso muscles is measured in each of a plurality of different angular positions defined by the apertures 111 formed in the sprocket disk 105 as best shown in FIG. 2. In this way the static strength of the subject's rotary torso muscles is correlated with respect to the position, that is, angular position of the subject's torso. The actual strength may be measured by any suitable means such as the strain gauge 112 which is connected between the movement arm and the sprocket in the manner described above. The static strength of the subject's rotary torso muscles in each of the various angular positions of the torso may be measured, recorded and displayed by means of a computer and video screen. The strain gauge of course measures the force of the rotary torso muscles while the angular position of the torso may be measured in any suitable manner such as by means of a potentiometer which in a specific embodiment is shown at 123 in FIG. 3 at the lower end of the movement arm adjacent the lower pivot shaft 65. When the apparatus is used in the exercise mode, the number of repetitions of the torso is measured, recorded and displayed by means of a computer and a video screen.

In order to limit the range of movement of the movement arm 60, 62 to suit a particular subject, the movement arm is provided at its upper end portion with horizontal plates 133 having a series of angularly spaced apertures 130 (see FIG. 2) for receiving a pin fixed to a lever 131 which may be rotated along the arc defined by the apertures 130 to place the pin in any of the apertures. The limit of movement of the movement arm will be determined by engagement of the outer end portion of lever 131 with a stop 132 fixed to the stationary frame of the apparatus as shown in FIG. 2.

SUMMARY OF OPERATION

To summarize the operation of the apparatus of the invention in accordance with the method of the invention, the subject enters the apparatus with the chest gate 76 of the cage in open position and with the arm 42 of the upper thigh pad 40 in the forward most, open position. The pivot arm 42 is then pivoted forwardly to the position shown in FIG. 3 and then the position of the footrest 27 is adjusted inwardly toward the subject's feet via rotation of the handwheel 34. Footrest 27 is adjusted until it engages the feet and causes the legs to break at the knees with the upper portions of the thighs in engagement against the upper pad 40 so that there can be no movement in the legs and the femur which should extend rearwardly and downwardly at an angle as shown in FIG. 3 in which position the pelvis will be prevented from pivoting about a horizontal axis by the femurs and by the pelvic pad 23 which engages the rear of the pelvis as shown in FIG. 3. It should be noted that even though the subject's legs and pelvis are secured against movement, the secured position of the subject is not uncomfortable or threatening in any way to the subject. Once the aforementioned position is achieved, the pivot arm 42 of the upper pad 40 is locked in place by pivoting the linkage actuating handle 50 to drive the linkage rod 48 to extend the pins 44 over the pivot arm 42 as shown in FIGS. 2 and 3. The thigh and hip pads 45 on the sides of the thighs are then actuated to bring them inwardly into engagement with the patient by means of the handwheel 54. Pads 45 should engage the opposite sides of the thighs and hips so as to prevent any lateral movement of the subject and to also assist in preventing any vertical movement of the subject.

After the subject's legs and pelvis are secured in the above manner, the chest gate 76 may be closed and latched. Then the handwheel 87 is turned to bring the chest pads 81 into the proper elevation relative to the chest and shoulder areas of the patient at which time, the handwheel 89 is turned to extend the chest cage 81 in engagement with the chest and shoulder areas of the subject to immobilize the upper section of the torso. Note also in FIG. 3 that in this position the upper back of the subject engages the upper back and head pad 72 as does the head of the patient.

The subject is now ready to have the static strength of the rotary torso muscles measured, and in order to proceed with such measurement, the locking pin 110 must be extended into one of the apertures 111 of the sprocket disk 105 to in effect connect the strain gauge 112 to the movement arm. Extension of the locking pin 110 is effected by manipulating the lever handle 118 which depends from the top of the machine. The sprocket disk 105 must also be locked against movement to operatively disconnect the weight stack from the sprocket 104. This is effected by extending the locking pin 121 into the block 120 of the sprocket disk 105. The aforementioned actuation is achieved by means of handle 122 at the top of the apparatus. In each of a plurality of different angular positions, determined by the positions of the apertures 111 and the sprocket 105, the applicant exerts with his rotary torso muscles torsional forces against the movement arm 60, 62 which would tend to rotate the movement arm about a vertical axis but for the securement of the movement arm against rotation by the locking pin 121. These forces are measured by the strain gauge 112, and to allow such measurement the upper pivot shaft 64 is fixed to the upper yoke 63 of the movement arm through a bearing which will accommodate movement of the strain gauge 112 in effecting the measurement. The measurements are stored in a processor and displayed on a video screen. After each measurement of static strength, it is of course necessary to remove the locking pin 110 from the disk 105 and then to reinsert the locking pin into another aperture 111 at another angular position of the rotary torso. The locking pin 110 is then extended and the process repeated.

After measurement of the static strength of the subject's rotary torso muscles is concluded, the dynamic strength or endurance of the subject's rotary torso muscles is tested. For this test, a suitable and safe resistance weight must be chosen for the particular subject. Having tested the subject's static strength, a resistance weight is chosen which is safely less in force than the maximum static strength of the subject's rotary torso muscles. The compound weight stack provides a great amount of flexibility in weight selections since the weights 92 of the upper stack are each less in magnitude than the weights 93 of the lower stack and since any combination of weights from the upper stack may be connected to the rod 94 with or without any combination of weights from the lower stack. Thus, for example, assuming the maximum static strength of the subject's rotary torso muscles is 100, a resistance weight may be chosen to provide resistance of 70 which of course is safely less than the maximum static strength 100 of the particular subject. After the weights are selected, they are keyed to the rod 94 and then the locking pin 121 is removed from the block 120 of the sprocket disk 105 to free the sprocket 104. The locking pin 110 is then extended through one of the apertures 111 of the sprocket disk to operatively connect the movement arm to the weight stack. The apparatus is now ready to be operated by the subject by exertion of the subject's rotary torso muscles against the movement arm and against the bias or load offered by the resistance weights. When the subject rotates in one direction against the load of the resistance weights the subject will of course raise the resistance weights and when the subject returns to the starting position the resistance weights will cause the movement arm to return to the starting position as the resistance weights descend. For testing purposes the subject is asked to repeat the aforementioned process until the subject can no longer lift the resistance weights through exertion of his rotary torso muscles at which point the test is concluded. During the test the number of repetitions is measured and recorded and as the magnitude of resistance weight is known, the strength of the subject's rotary torso muscles in terms of work or endurance or repetitions per known resistance weight, is established. After the dynamic test or exercise is concluded, for new patients or subjects, the static strength of the rotary torso muscles is measured again to determine the effect of the dynamic test or exercise on the static strength of the rotary torso muscles. This comparison provides useful information relative to the subject's muscles fibers in the rotary torso muscles and also with respect to establishing an exercise or rehabilitation program.

It should be noted that during the dynamic test or exercise of the rotary torso muscles as described above, the apparatus is designed so that the resistance weights 92 and/or 93 will be lifted with a maximum stroke on the order of about 3 inches. This ensures that on the return movement of the movement arm as the weights descend, no substantial kinetic energy can be developed which could injure the rotary torso muscles. This coupled with the fact that the resistance weights are safely less than the static strength of the rotary torso muscles and furthermore that the resistance weights are freely yieldable as the subject exerts rotary torso forces against the movement arm, results in a very safe exercise. Moreover during the dynamic exercise or test, the subject is asked to exert forces smoothly and slowly against the movement arm without any jerking movements and of course without any impact against the movement arm.

In the preferred embodiment, the dynamic exercise is started with the subject's torso facing towards one side in an extreme position depending on the subject's range of movement. The subject then exerts with his rotary torso muscles a force to gradually, smoothly and slowly rotate the movement arm towards the other side causing the movement arm to rotate about the axis of the pivot shafts 64 and 65 and the resistance weights to be lifted. In this phase of exercise, the rotary torso muscles produce positive work to lift the resistance weight. When the rotary torso reaches the extreme position on the side opposite, the starting position, the subject begins to return the torso towards the starting position and again rotates the torso smoothly, slowly and gradually during which time the rotary torso muscles are producing negative work as the resistance weight descends towards the starting position and returns the movement arm to the starting position. The exercise is repeated until the subject can no longer produce positive work. The opposite rotary torso muscles are now exercised. In other words the starting position of this exercise is in the opposite extreme position relative to that of the first exercise described above. In this exercise phase, positive work is performed while the rotary torso rotates in a direction opposite to the direction of positive work as performed in the first test or exercise described above. It should be understood from the above that opppositely located rotary torso muscles associated with the thoracic vertebrae are respectively responsible for rotating the torso in opposite directions about the vertical axis of the vertebrae. Therefore, two such oppositely directed tests or exercise phases are required. As noted above, during one phase one of the pulleys 99 or **99*a* will drive the cam 98 while during the opposite phase, the other pulley 99 or 99*a* will drive the cam 98 (see FIG. 2**). During each phase of exercise, the number of repetitions of the torso is measured and recorded and displayed on a video screen through suitable equipment.

When it is desired to specifically limit the range of movement of the subject's torso, prior to the exercise, the lever 131 is raised and moved to position its depending pin in appropriate aperture 130 in the frame on the front top portion of the apparatus as best shown in FIG. 2. The range of movement will be determined when the lever 131 engages the stop 132. In this way, the range of movement for certain subjects or patients can be limited to suit the particular condition of the subject.

What is claimed is:

1. Apparatus for testing and/or exercising rotary muscles of a portion of the human body, the apparatus comprising in combination, a seat for receiving a subject in seated position, a movement arm rotatable about a generally vertical axis in response to forces generated by said muscles, means on the movement arm for securing the upper torso of the subject to the movement arm against movement relative to the movement arm, and resistance means connected to the movement arm for opposing rotation of the movement arm in one direction in response to forces generated by said rotary muscles and wherein said means for securing the upper torso includes at least one pad engageable with the chest area of the subject, a backrest engageable by the upper back of the subject and a headrest engageable by the head of the subject.

2. The apparatus defined in claim 1 further including means for securing the pelvis of the subject against movement such that the subject's rotary torso muscles are isolated for generating forces to rotate the movement arm about said vertical axis.

3. The apparatus defined in claim 2 wherein said means for securing the pelvis against movement includes a pelvic pad engageable by the lower rear of the subject, and means for preventing movement of the subject's legs.

4. The apparatus defined in claim 3 wherein said means for preventing movement of the subject's legs includes a footrest engageable by the feet of the subject and a pad engageable by upper portions of the subject's legs above the knees.

5. The apparatus defined in claim 1 further including means for moving the chest pad towards or away from the chest of the subject when the subject is seated on said seat, and means for adjusting the elevation of the chest pad.

6. The apparatus defined in claim 1 wherein there is further included means mounting the chest pad for movement around a vertical axis between a closed operative position for engaging the chest of the subject and an open position for providing access to the seat.

7. The apparatus defined in claim 1 further including a drive disk mounted about said vertical axis for rotation, means including a strain gauge releasably connecting the drive disk to the movement arm for rotating the drive disk upon rotation of the movement arm, and means interconnecting the drive disk and said resistance means.

8. The apparatus defined in claim 7 wherein there is further included means for locking the drive disk against movement about said axis.

9. The apparatus defined in claim 7 further including means for limiting the range of movement of the drive disk about said vertical axis.

10. Apparatus defined in claim 1 wherein said resistance means includes one or more dead weights which are lifted upon rotation of the movement arm and means limiting the maximum stroke of the dead weights to on the order of three inches.

11. Apparatus for testing and/or exercising muscles of the human body, the apparatus comprising in combination, a movement arm movable about a generally vertical axis in response to forces generated by said muscles, securement means on the movement arm for securing the chest area of the subject against movement to isolate the chest area from said muscles, and resistance means connected to the movement arm to oppose movement of the movement arm about said axis in response to forces generated by said muscles and wherein said securement means secures the chest area to the movement arm and includes a pad movable about a generally vertical axis between an operative position for engaging the chest of the subject and an inoperative position removed from the chest of the subject.

12. Apparatus defined in claim 11 wherein said securement means includes a mounting member holding the pad, and means for moving the mounting member in a generally horizontal plane towards or away from the chest area.

13. Apparatus defined in claim 12 further including means for moving said mounting member in a generally vertical direction for adjustment.

14. Apparatus for testing and/or exercising muscles of the human body, the apparatus comprising in combination, a movement arm movable about a generally vertical axis in response to forces generated by said muscles, securement means on the movement arm for securing the chest area of the subject against movement to isolate the chest area from said muscles, resistance means connected to the movement arm to oppose movement of the movement arm about said axis in response to forces generated by said muscles and means including a strain gauge connecting said resistance means to said movement arm, said strain gauge having one end connected to said movement arm and an opposite end connected to a member mounted for rotation about said axis and releasably 15. Apparatus for testing and/or exercising muscles of the human body, the apparatus comprising in combination, a movement arm movable about a generally vertical axis in response to forces generated by said muscles, securement means on the movement arm for securing the chest area of the subject against movement to isolate the chest area from said muscles, resistance means connected to the movement arm to oppose movement of the movement arm about said axis in response to forces generated by said muscles and means for limiting movement of said movement arm about said vertical axis and wherein said means for limiting movement of said movement arm includes a generally horizontal member fixed to the movement arm and having a plurality of horizontally spaced apertures for receiving a pin mounted on the movement arm and a stationary stop member engageable with said pin.

16. Apparatus for testing and/or exercising muscles of the human body, the apparatus comprising in combination, a movement arm movable about a generally vertical axis in response to forces generated by said muscles, securement means on the movement arm for securing the chest area of the subject against movement to isolate the chest area from said muscles, and resistance means connected to the movement arm to oppose movement of the movement arm about said axis in response to forces generated by said muscles and wherein said securement means includes a pad, a mounting member holding the pad, and means for moving the mounting member in a generally horizontal plane towards or away from the chest area.

17. Apparatus defined in claim 16 further including means for moving said mounting member in a generally vertical direction for adjustment.

* * * * *

UNITED STATES PATENT AND TRADEMARK OFFICE

CERTIFICATE OF CORRECTION

PATENT NO. : 5,004,230

DATED : April 2, 1991

INVENTOR(S) : ARTHUR JONES

It is certified that error appears in the above-identified patent and that said Letters Patent is hereby corrected as shown below:

In the last line of Claim 14, Column 12, line 21, please add the following:

----connected to said resistance means.-----

Signed and Sealed this

Third Day of November, 1998

Bruce Lehman

*Attest:*

BRUCE LEHMAN

*Attesting Officer*

*Commissioner of Patents and Trademarks*